United States Patent [19]

Yee

[11] Patent Number: 4,882,760

[45] Date of Patent: Nov. 21, 1989

[54] SOUND REPRODUCTION SYSTEM

[76] Inventor: Raymond M. Yee, 1716 Grand Ave., Phoenix, Ariz. 85007

[21] Appl. No.: 54,047

[22] Filed: May 26, 1987

Related U.S. Application Data

[63] Continuation of Ser. No. 557,531, Dec. 2, 1983, abandoned.

[51] Int. Cl.[4] ..... H04R 1/02; H04R 1/24

[52] U.S. Cl. ..... 381/90; 181/199; 381/24; 381/88; 381/89; 381/99; 381/159; 381/182; 381/186; 381/188; 381/205

[58] Field of Search ..... 381/90, 88, 89, 99, 381/24, 159, 182, 188, 205, 186; 181/144, 199

[56] References Cited

U.S. PATENT DOCUMENTS

| | | | |
|---|---|---|---|
| 1,667,149 | 4/1928 | Gerlach | 181/144 |
| 1,667,251 | 4/1928 | Fay et al. | 381/186 |
| 1,932,343 | 10/1932 | Holland | 181/144 |
| 2,114,680 | 4/1938 | Goldsmith | 381/17 |
| 2,145,318 | 1/1939 | Schenk et al. | 381/182 |
| 2,179,840 | 11/1939 | Bucky | 381/90 |
| 2,203,715 | 6/1940 | Benecke | 381/186 |
| 2,768,702 | 10/1956 | Lowry | 381/89 |
| 2,831,060 | 4/1958 | Kleis | 381/90 |
| 3,054,856 | 9/1962 | Arany | 381/89 |
| 3,393,764 | 7/1968 | Schafer | 381/159 |
| 3,512,606 | 5/1970 | Anastin | 181/144 |
| 3,627,948 | 12/1971 | Nichols | 381/59 |
| 3,686,446 | 8/1972 | Manger | 381/117 |
| 3,824,343 | 7/1974 | Dahlquist | 381/90 |
| 3,931,867 | 1/1976 | Janszen | 181/144 |
| 3,983,333 | 9/1976 | Allison | 381/89 |
| 4,006,308 | 2/1977 | Pönsgen | 381/159 |
| 4,006,311 | 2/1977 | Carlsson | 381/24 |
| 4,015,089 | 3/1977 | Ishii et al. | 381/99 |
| 4,139,734 | 2/1979 | Fincham | 381/159 |
| 4,179,585 | 12/1979 | Herrenschmidt | 381/182 |
| 4,199,657 | 4/1980 | Lane | 381/24 |
| 4,268,719 | 5/1981 | Manger | 381/89 |
| 4,296,280 | 10/1981 | Richie | 381/99 |
| 4,326,099 | 4/1982 | Maille | 381/24 |
| 4,348,552 | 9/1982 | Sicone | 381/99 |
| 4,365,113 | 12/1982 | Soma et al. | 381/182 |
| 4,365,114 | 12/1982 | Soma | 381/182 |
| 4,410,063 | 10/1983 | Yasue et al. | 381/99 |

FOREIGN PATENT DOCUMENTS

| | | | |
|---|---|---|---|
| 2251178 | 5/1974 | Fed. Rep. of Germany | 381/88 |
| 2525705 | 12/1976 | Fed. Rep. of Germany | 381/88 |
| 2756299 | 7/1979 | Fed. Rep. of Germany | 381/90 |
| 53-32701 | 3/1978 | Japan | 381/24 |
| 54-153022 | 12/1979 | Japan | 381/89 |
| 58-162191 | 9/1983 | Japan | 381/90 |
| 388373 | 6/1973 | U.S.S.R. | 381/24 |

*Primary Examiner*—Jin F. Ng
*Assistant Examiner*—Danita R. Byrd
*Attorney, Agent, or Firm*—John C. Smith, Jr.

[57] ABSTRACT

A system for reproducing sound, particularly musical sound, giving enhanced pleasure to the listener. The system utilizes a pair of low frequency range speakers, a plurality of high frequency range speakers and may employ one or more mid frequency range speakers, all of which speakers are of conventional construction. These speakers are, however, disposed in a novel mechanical arrangement and electrically interconnected in a manner to emanate sound in essentially a non-directional manner. The listener thus perceives the sound to be emanating from the dimensional space surrounding the system, rather than from a single point or plane, and experiences the sound much as if he or she were in the same enclosure with live performers, rather than listening to a recording. Achievement of these results is attributable in part to the pair of low frequency range speakers being disposed in a cabinet facing outwardly of opposite faces respectively of the cabinet and being connected to a source of electrical signals in such a manner that the speakers operate in a push-pull manner. The mechanical arrangement of the system is completed by the high frequency range speakers being mounted on the cabinet in a manner to face upwardly of the cabinet and the mid frequency range speaker being mounted on the cabinet to face generally toward the listener.

22 Claims, 1 Drawing Sheet

SOUND REPRODUCTION SYSTEM

This application is a continuation, of application Ser. No. 557,531 filed Dec. 2, 1983, now abandoned.

TECHNICAL FIELD

This invention relates to systems for reproducing recorded sound, particularly musical sound, in a manner to enhance the pleasure of the listener.

BACKGROUND ART

The ultimate objective of any system for reproducing recorded music is to produce sound which to the listener is indistinguishable from a live performance.

When a person listens to a live performance of a musical work in, for example, a concert hall, he is subjected to a wealth and variety of sounds, some of which travel directly to the listener from the performers and others of which reach the listener through a profusion of reflections and reverberations within the hall itself. This fullness, or richness, of sound which one experiences from a live performance is usually missing from the home reproduction systems.

The sophisticated recording apparatus in use today are in large measure, capable of "catching" all the nuances of sound emanating from a live performance and some of the records in use today are capable of holding and generating electrical signals corresponding to that quality of sound. However, most home sound reproduction systems which are affordable by the average individual are not capable of reproducing the live performance sounds. This is true even through the home systems are frequently equipped with a multiplicity of speakers specially adapted to reproduce sounds in the low, mid and high frequency ranges exhibited by most musical compositions. Most home systems in use today are also capable of reproducing two channel, or stereophonic, sound and some are even capable of quadraphonic reproduction.

It has been recognized in the past that the practice of placing several speakers of different frequency ranges in a single cabinet or enclosure and mounted on a single baffle board in such a manner that all the speakers in the system are aimed generally at the listener inherently limits the quality of sound which the listener perceives. The sound reproduced by such systems are perceived by the listener as coming from either a point source within each of the speaker enclosures or a wall, or plane, containing the speakers. The listener perceives that the sound is being directed at him rather than surrounding him as often is the case in the live performance.

In efforts to get away from this point or wall source of sound, prior inventors have resorted to displacing the speakers in the system physically with respect to each other and reorienting the speakers so that they direct the sound in various directions. At least in theory, some of these systems are intended to produce non-directional, or omni-directional, sound more like a live performance.

U.S. Pat. No. 3,054,856 granted Sept. 18, 1962 to D. Arany for "Sound Reproducing System" discloses a system in which several speakers are redirected within an enclosure in an attempt to obtain "non-directional" emission of sound. This system utilizes a pair of low frequency range, or woofer, speakers disposed in the ends of a closed chamber in such a manner that the speakers are directed at each other. These speakers are electrically connected in such a manner that they vibrate in the same direction in response to a signal. In other words, they are arranged in a push-pull arrangement. Several high frequency range, or tweeter, speakers are disposed in the chamber intermediate the woofer speakers and directed radially outwardly in four quadrants of the chamber.

The Arany patent represents that the low frequency range speaker disposition there employed has the effect of accentuating the low frequency radiation and because the sound emanates from the rear, or convex side, of these speakers, instead of the more conventional direction from the concave side of the speakers the sound is sent out evenly in all directions without the directional remission of a typical commercial installation. So far as is known, this sound reproduction system has achieved no measureable listener recognition nor any commercial success.

U.S. Pat. No. 4,006,311 granted Feb. 1, 1977 to S. Carlsson for "Stereophonic Sound Reproducing Apparatus" discloses another sound reproducing system in which the low, mid and high frequency range speakers are oriented in different directions in an attempt to achieve an omni-directional reproduction of sound. The basic principle underlying this system is the recognition that there should be a certain ratio between the quantity of sound passing directly to the listener and the quantity of sound reflecting off the walls of the listening room. To this end, the speakers are oriented in such a manner as to direct sound therefrom at specific angles to adjoining walls of the room. The disadvantage of such a system, even if practical, is that for proper operation the speaker enclosure or enclosures must be strategically placed with respect to the walls of the room and with respect to the listener, thereby greatly reducing the versatility of such a system.

U.S. Pat. No. 4,199,657 granted Apr. 22, 1980 to H. Lane for "Planar Sound Reproducing Speaker System" purports to solve a resonance problem existing in conventional sound reproducing systems having more than one speaker within one cabinet. Lane proposes disposing several high frequency range speakers in individual cabinets supported by tubular members sticking out of the side walls of another cabinet carrying the mid range speaker. This combination of high and mid range speakers is supported on another post having a stand isolated from a cabinet housing the low frequency range speaker. This system has also failed to receive any critical appreciation from discriminating listeners.

DISCLOSURE OF INVENTION

The principal object of the present invention is to reproduce recorded sound in such a manner that the sound seems to emanate from around the system structure rather than directly from the structure or a plane containing the structure. The effect achieved by the invention is that the listener perceives the sound to be appearing as an aura surrounding the reproducing system much as he might perceive the sound emenating from a live performance, thereby enhancing his pleasure of listening to the reproduction of the recorded sound.

This objective and the desired results are achieved by particular mechanical and electrical arrangements of what otherwise are conventional components making up the sound reproducing system. In other words, the improved system utilizes conventional low, mid and high frequency speakers, but through orientation and electrical connection these conventional components are invoked to produce unexpected sound reproduction.

There are two basic concepts underlying the present invention. The first of these concerns the disposition and operation of the low frequency range speakers embodied in the system. The second concept centers on the high frequency range speakers. So far as the low frequency range is concerned, this invention contemplates using two conventional low frequency range, or woofer, speakers disposed within a single cabinet, or enclosure, in such a manner that the speakers are directed outwardly from opposite faces of the cabinet. These low frequency range speakers are connected electrically to operate in a push-pull fashion. In other words, the electrical signals received by the respective low range speakers are 180° out of phase with each other so that the moveable elements of each of the two speakers, although they are facing in opposite directions, are simultaneously urged to move in the same direction. In this manner, the moveable elements of the speakers compliment each other and do not interfere with the movement of each other so far as the interior of the cabinet is concerned. Sound from the low frequency range speakers is directed outwardly of the cabinet in opposite directions, one direction toward the listener and the other direction away from the listener. This disposition has the effect of enhancing the inherently non-directional characteristics of low frequency sound. The sound which comes out of and surrounds the cabinet housing the low frequency speakers appears as an aura or a vortex around the speaker cabinet.

It is also critical to the invention that the high frequency range, or tweeter, speakers be directed away from the listener and preferably generally in a direction at right angles to the direction of the low frequency range speaker facing the listener. Sound issuing from a high frequency range speaker is highly directional and if directed toward the listener is immediately perceived to be emanating from a particular spot, i.e. the high frequency speaker. This effect is entirely altered by directing the sound from the high frequency range speakers outwardly through the aura or vortex of the low frequency sound surrounding the cabinet. It is further preferred that a plurality of high frequency range speakers be used and that these be stacked in an array above the low frequency range cabinet in such a manner that each ascending succeeding speaker is displaced rearwardly, i.e. away from the listener, by at least some small amount. This disposition of the high frequency speakers has the effect of further minimizing the customary, highly localized performance characteristics of such speakers.

The system embodying this invention also preferably includes at least one mid frequency range speaker to blend in and fill in between the low and high frequency speakers. The positioning of this particular speaker is not as critical as is the positioning of the low and high frequency range speakers but it is preferably located outside and above the cabinet or enclosure for the low frequency range speakers.

BRIEF DESCRIPTION OF DRAWINGS

The invention will be described in greater detail with reference to the accompanying drawings wherein.

BEST MODE FOR CARRYING OUT THE INVENTION

Figure 1:
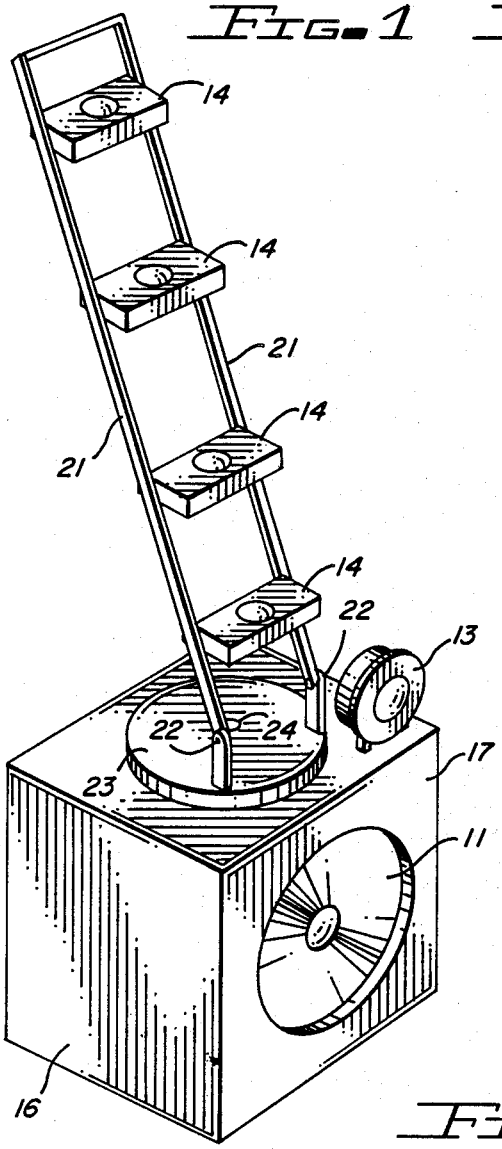
FIG. 1 is a three-quarter perspective view from above of a sound reproduction system embodying the invention.
Figure 2:
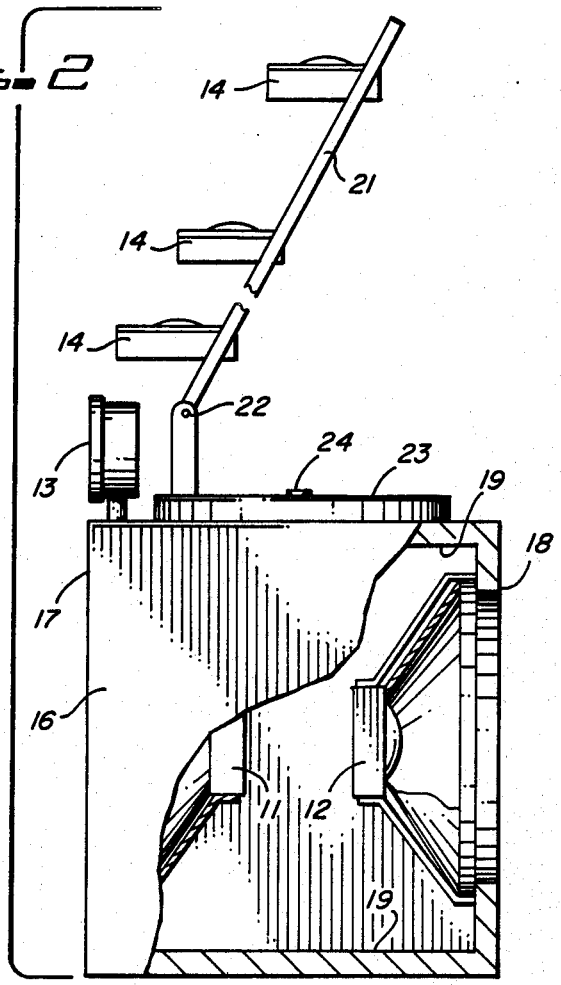
FIG. 2 is side elevational view of the system of FIG. 1 with portions broken away to show the interior of the cabinet containing the low frequency range speakers and with the high frequency range array foreshortened.
Figure 3:
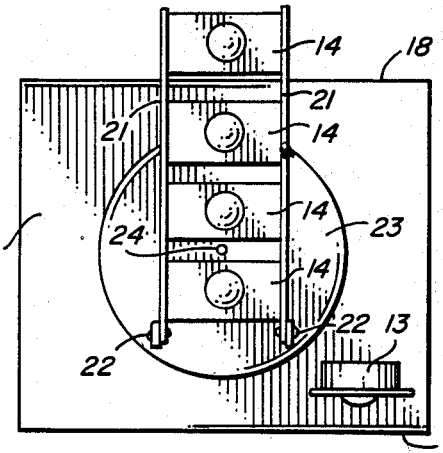
FIG. 3 is a plan view from above of the sound reproduction system of FIG. 1.

FIGS. 1, 2 and 3 collectively illustrate the mechanical arrangement of components in a sound reproduction system embodying this invention. The principal components are a pair of low frequency range, or woofer, speakers 11 and 12, a mid frequency range speaker 13 and a plurality of high frequency range, or tweeter, speakers 14.

All of the aforementioned speakers are of conventional construction and of the types commonly used in home sound reproducing systems. The low frequency range speakers 11 and 12 preferably have a diameter of from approximately 15 inches to approximately 20 inches and are capable of high compliance sound output down to 40 Hz. Speakers 11 and 12 are housed within a cabinet, or enclosure, 16 having opposite front and rear walls 17 and 18 on which front and rear speakers 11 and 12, respectively, are mounted. Walls 17 and 18 have openings therein through which speakers 11 and 12 can project sound outwardly of the cabinet 16. Cabinet 16 is preferably made of plywood and may have its top and side walls dampened by the application of a fiberglass mat 19.

Mid frequency range speaker 13 is preferably mounted atop cabinet 16 near one of the front corners thereof. If the sound reproducing system of this invention is to be used in pairs as it would be for stereophonic sound reproduction the two systems would preferably have their mid range speakers 13 mounted at opposite front corners and preferably at that corner nearest to the other sound reproducing system.

A plurality of high frequency range speakers 14 are employed in accordance with this invention and their number usually will range from two to four speakers. Speakers 14 are preferably carried in stacked array above cabinet 16 by support means comprising a pair of angle bars 21 pivotally connected at their lower ends 22 to a base 23 resting atop cabinet 16. Base 23 may, if desired, be positioned above a spindle 24 projecting upwardly from cabinet 16 and about which base 23 and the array of high frequency range speakers 14 may be rotated about a vertical axis. If desired, spindle 24 can be eliminated in which case base 23 simply rests atop cabinet 16 and can be moved about on the cabinet.

Figure 4:
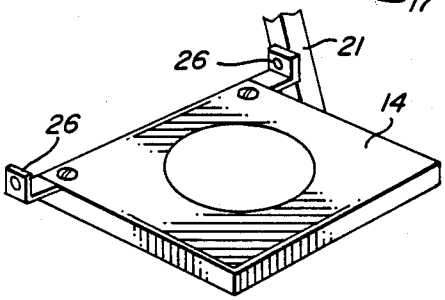
FIG. 4 is a fragmentary perspective view illustrating the mounting details for one of the high frequency range speakers of the system.

The purpose of the pivotal connection at the lower ends 22 of angle bars 21 is to permit the bars to be swung backward or forward on the pivots to vary the distance between the high frequency range speakers 14 and a listener positioned in front of the sound reproducing system. The exact position of angle bars 21 is a matter of personal preference to the individual listener, but it has been determined that positioning these bars at approximately 50° to 60° from the horizontal will give the most desirable results. Each of the high frequency range speakers 14 is preferably secured to the angle bars 21 by means of pivotal connections 26 (see FIG. 4) permitting the angular relationship between the speakers and the bars to be changed when the bars are moved. Sound emanating from high frequency range speakers is highly directional in character and in order to obtain the non-directional, or omni-directional, effect sought of this improved sound reproduction system, the high frequency range speakers 14 must not be pointed directly at the listener. In fact, the most pleasing effects are achieved with the high frequency range speakers 14 pointing in a direction generally at right angles to the directions in which the low frequency range speakers 11 and 12 are pointing. With the floor mounted system illustrated in FIGS. 1 to 3 and described above speakers 14 are preferably disposed to project sound upwardly. It should be appreciated, however, that the system can be turned on its side or turned upside down for suspension from the ceiling.

Figure 5:
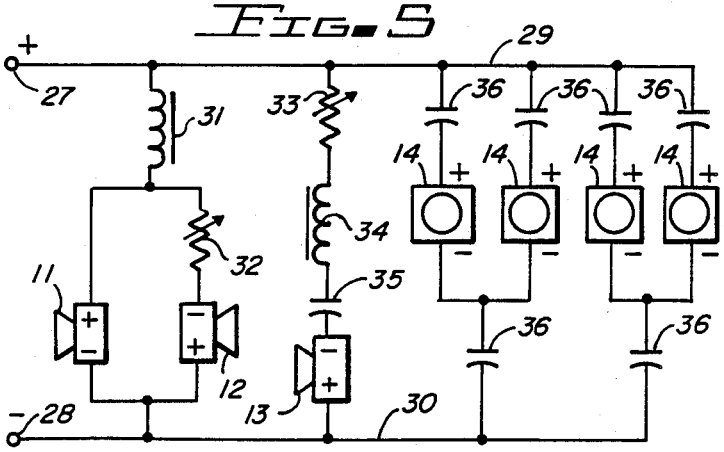
FIG. 5 is a schematic illustration of the electrical circuitry for the sound reproduction system.

In addition to the aforementioned mechanical arrangement, or disposition, of the components of this improved sound reproduction system, the invention contemplates a particular electrical arrangement of the components as well. The preferred circuit diagram for the components is illustrated in FIG. 5 wherein the various speaker components are identified by the same reference numerals utilized heretofore. This circuit includes a pair of input terminals 27 and 28, designated positive and negative respectively, and adapted to receive electrical signals from a conventional amplifier. Positive terminal 27 is connected to a lead 29 for delivering electrical impulses to one electrical side of each of the speakers 11, 12, 13 and 14. The negative terminal 28 is connected to a negative lead 30 connected to an opposite electrical side of each of the speaker components. Positive lead 29 is connected via choke 31 to a, so-called, positive terminal on forward facing low frequency range speaker 11. Negative lead 30 is connected to a, so-called, negative terminal on speaker 11. In accordance with this invention electrical connections to the rear low frequency range speaker 12 are reversed with respect to forward speaker 11. In this case positive lead 29 is connected via choke 31 and through a variable resistor 32 to a, so-called, negative terminal on rear low frequency range speaker 12. Negative lead 30 is connected to a, so-called, positive terminal on speaker 12. By this arrangement the speakers 11 and 12 receive electrical signals which are essentially 180° out of phase with respect to each other with the result that when the speaker cone of the forward speaker 11 is caused to move forward the speaker cone of rear speaker 12 moves rearwardly with respect to the speaker itself, but also forwardly of the cabinet. The moveable elements of two speakers 11 and 12 are thus operated in a, so-called, push-pull fashion. The effect of speakers 11 and 12 operating in this fashion is the generation of a sound field radiating as an aura around the exterior of cabinet 16. A listener perceives the sound as coming not from speakers 11 and 12 but from the space surrounding the cabinet 16.

The relative electrical drive to speakers 11 and 12 can be adjusted to the listener's preference by means of variable resistor 32 which adjusts the strength of electrical signals reaching rear speaker 12.

Choke 31 is one part of what is normally termed a "cross over network" which filters the electrical signals sent to the sound reproduction system from the amplifier so that the low, mid and high frequency range speakers, respectively, receive just the signals of frequencies which they are capable of converting to audible sound without distortion.

Mid range speaker 13 is also connected to leads 29 and 30 with lead 29 being connected through a variable resistor 33 to control the volume of speaker 13 and other components of the cross over network consisting of a choke 34 and a condensor 35. Positive lead 29 is preferably connected to the, so-called, negative connection on speaker 13, which means that the negative lead 30 is connected to the so-called positive connection.

That portion of the cross over network controlling the feed of electrical signals to the high frequency range speakers 14 consists of a plurality of condensers 36 preferably connected to the speakers 14 in the manner shown in FIG. 5. The arrangement there shown includes one condensers 36 connected between the, so-called, positive connection on each speaker 14 and positive lead 29. Another pair of condensers 36 are connected between negative lead 30 and the, so-called, negative connections on two pairs of speakers 14.

The mechanical and electrical arrangement of components described above provides a sound reproduction system capable of producing essentially omni-directional sound to enhance the listening pleasure of the user of the system. In recognition of the fact that listening preferences vary from person to person, there are built into the system a number of adjustment features by which the system can be "tuned" to the particular user's taste. From an electrical standpoint variable resistor 33 permits the user to balance the volume coming from the low frequency range speakers 11 and 12 and the mid frequency range speaker 13 so that there is a blending of the sound from these speakers with the sound coming from the remainder of the system. Adjustment of the angular position of support bars 21 permits the user to vary the distance between himself and the several high frequency range speakers 14 and moving the entire high frequency range speaker array on cabinet 16 enables the user to change the characteristics of the high frequency range of the sound generated by the system.

What is claimed is:

1. A sound reproduction system comprising:

(a) a closed walled cabinet having a base, a top and wall means including front and rear wall portions extending between said base and top, said front and rear wall portions facing in opposite directions, respectively, each of said front and rear wall portions having an opening therein;

(b) two high compliance, low frequency range speakers adjacent said openings in said front and rear wall portions, respectively, and having a concave surface at the front of the speaker and a convex surface at the rear of the speaker, the front of one of said low frequency range speakers facing said opening in said front wall portion and the front of the other of said low frequency range speakers facing said opening in said rear wall portion such that the front concave surfaces of said low frequency range speakers face in opposite directions;

(c) electrical driving means;

(d) circuit means connecting said driving means to said two low frequency range speakers, said driving means being adapted to cause said two low frequency range speakers to operate in a push-pull manner with outwardly urged excursion of said concave surface of one of said low frequency range speakers occurring with the simultaneous inwardly urged excursion of said concave surface of the other of said low frequency range speakers;

(e) said base being adapted to support said cabinet such that the projection axis of each of said two speakers is oriented in a substantially horizontal direction, and each of said two speakers being adapted to be directly coupled to an air propagating medium surrounding said cabinet without any intervening sound modifying means between each of said speakers and said air propagating medium whereby said two low frequency range speakers are caused to generate a sound field which radiates as an aura around the exterior of said cabinet with the sound perceived to be coming from the space surrounding said cabinet rather than from said speakers; and (f) a plurality of high-frequency range speakers and means mounted on said closed walled cabinet for supporting said plurality of high-frequency range speakers in a stacked array, spaced from each other and in nonaxial alignment above said closed walled cabinet with each of said high-frequency range speakers arranged to direct sound upwardly, substantially orthogonally to the directions of radiation of said two low-frequency range speakers mounted within said closed walled cabinet.

2. The sound reproduction system of claim 1 wherein each of said low frequency range speakers comprises electrically conductive negative and positive terminals and said circuit means comprises electrically conductive negative and positive leads, said negative lead being connected to the negative terminal of one of said two low frequency range speakers and to the positive terminal of the other of said two low frequency range speakers and said positive lead being connected to the positive terminal of said one of said two low frequency range speakers and to the negative terminal of said other of said two low frequency range speakers, whereby the negative and positive leads to one of said two low frequency range speakers are 180° out of phase with respect to the leads to said other of said two low frequency range speakers.

3. The sound reproduction system of claim 2 wherein said circuit means comprises variable resistance means interposed between said driving means and one of said two low frequency range speakers for control of signal intensity supplied to one of said two low frequency range speakers relative to the other of said two low frequency range speakers.

4. The sound reproduction system of claim 1 wherein said means for supporting said speakers is adapted to arrange said stacked array of a plurality of high frequency range speakers in a generally colinear relationship wherein the array is at an angle of less than 90° from the horizontal such that the lowermost high frequency range speaker is closest to a vertical plane defined by said front wall portion of said closed wall cabinet and each successively higher high frequency range speaker in said stacked array is disposed progressively closer to a vertical plane defined by said rear wall portion of said closed wall cabinet.

5. The sound reproduction system of claim 1 further comprising a mid-range speaker mounted on said closed walled cabinet.

6. A sound reproduction system comprising:

two moving element high compliance, low frequency range speakers;

a speaker enclosure having a base, a top and wall means including a pair of generally opposed side walls, each with a speaker opening therein, extending between said base and top;

means for conventionally mounting one of said speakers in said speaker opening in each of said opposed side walls of said enclosure such that the moving element of each of said speakers radiates outwardly in opposite directions;

means for driving said speakers in a push-pull manner with outwardly urged excursion of said moving element of one of said low frequency range speakers occurring with the simultaneous inwardly urged excursion of said moving element of the other of said low frequency range speakers;

said base being adapted to support said speaker enclosure such that the projection axis of each of said two speakers is oriented in a substantially horizontal direction, and each of said two speakers being adapted to be directly coupled to an air propagating medium surrounding said speaker enclosure without any intervening sound modifying means between each of said speakers and said air propagating medium whereby said two low frequency range speakers are caused to generate a sound field which radiates as an aura around the exterior of said enclosure with the sound perceived to be coming from the space surrounding said enclosure rather than from said speakers; and high frequency range speakers coupled to said speaker enclosure, said high frequency range speakers being arranged in a stacked array, spaced from each other and in nonaxial alignment with each of said high frequency range speakers arranged to direct sound upwardly, substantially orthogonally to the directions of radiation of said two low frequency range speakers mounted within said enclosure.

7. The sound reproduction system of claim 6 wherein said mounting means adjustably maintains the position of said high frequency range speakers in said stacked array in a generally colinear relationship which is at an angle of less than 90° from the horizontal such that the high frequency range speaker arrayed furthest from said speaker enclosure is a greater distance from a listener than is the high frequency range speaker arrayed closest to said enclosure.

8. The sound reproduction system of claim 6 further comprising means coupled to at least one of said two moving element speakers for adjusting the level of drive of said speaker relative to the level at which the second of said two speakers is driven.

9. The sound reproduction system of claim 6 further comprising a mid-frequency range speaker coupled to said speaker enclosure.

10. The sound reproduction system of claim 6 further comprising a mid-frequency range speaker coupled to said speaker enclosure.

11. A method for assembling a sound reproduction system for generating a sound field perceivable as emanating from the space surrounding the sound reproduction system rather than from the sound reproduction system itself, comprising the steps of:

mounting a pair of moving element high compliance, low frequency range speakers one each to generally opposed side walls of a sound enclosure for radiating outwardly therefrom in generally opposite directions and such that each of said pair of speakers is adapted to be directly coupled to an air propagating medium surrounding said enclosure without any intervening sound modifying means between each of said speakers and said air propagating medium;

positioning said sound enclosure such that the projection axis of each of said speakers is oriented in a, substantially horizontal direction;

driving said speakers in a push-pull manner with outwardly urged excursion of the moving element of one of said low frequency range speakers occurring with the simultaneous inwardly urged excursion of the moving element of the other of said low frequency range speakers to cause said two low frequency range speakers to generate a sound field which radiates as an aura around the exterior of said enclosure with the sound perceived to be coming from the space surrounding said enclosure rather than from said speakers; and coupling a stacked array of high frequency range speakers to said sound enclosure with said high frequency range speakers arranged spaced from each other, in nonaxial alignment and generally colinearly at an angle of less than 90° from the horizontal, such that the lowermost high frequency range speaker is closest to a plane defined by one of said opposed side walls and successively higher high frequency range speakers in said stacked array are disposed progressively closer to a plane defined by the other of said opposed side walls, each of said high frequency range speakers facing upwardly at right angles to said opposite, horizontal directions of radiation of said low frequency range speakers and driving said high frequency range speakers at a frequency higher than that at which said pair of enclosure-mounted low frequency range speakers are driven.

12. The method of claim 11 further comprising the steps of coupling a mid-frequency range speaker to said sound enclosure and driving said mid-frequency range speaker in a frequency range between that at which said pair of enclosure-mounted speakers is driven and that at which said high frequency range speakers are driven.

13. The method of claim 12 further comprising the step of adjusting the drive level of one of said enclosure-mounted speakers relative to the drive level of the second of said enclosure-mounted speakers.

14. The method of claim 13 further comprising the step of positioning said speaker enclosure such that one of said enclosure-mounted speakers radiates generally in a direction toward a listener while the second of said speakers radiates in a direction away from the listener.

15. A sound reproduction system comprising:

a cabinet having opposite faces, wherein said opposite faces are front and rear faces in relation to a listener;

a pair of low frequency range speaker means mounted in said cabinet and facing outwardly of said opposite faces, respectively;

a plurality of high frequency range speaker means and support means for supporting a plurality of high frequency range speaker means mounted above said cabinet, said support means supporting said plurality of high frequency range speaker means in a stacked array, spaced from each other, in nonaxial alignment and in a generally colinear relationship which is at an angle of less than 90° from the horizontal, such that the lowermost high frequency range speaker means is closest to a plane defined by said front face and successively higher high frequency range speaker means in said stacked array are disposed progressively closer to a plane defined by said rear face, each of said high frequency range speaker means facing upwardly at right angles to the direction in which said low frequency range speaker means are facing; and means for supplying electrical signals to said low frequency range speaker means and said plurality of said high frequency range speaker means, said signal supplying means being connected to each of said pair of low frequency range speaker means in a manner such that said pair of low frequency range speaker means operate in a push-pull manner with outwardly urged excursion of one of said low frequency range speaker means occurring with the simultaneous inwardly urged excursion of the other of said pair of low frequency range speaker means to cause said pair of low frequency range speaker means to generate a sound field which radiates as an aura around the exterior of said cabinet with the sound perceived to be coming from the space surrounding said cabinet rather than from said speaker means.

16. The sound reproduction system of claim 15 wherein said cabinet is emplaced adjacent to a floor and said high frequency range speaker means face upwardly of said cabinet.

17. The sound reproduction system of claim 15 further including a mid-frequency range speaker means mounted on said cabinet.

18. The sound reproduction system of claim 15 further including a mid-frequency range speaker means mounted on said cabinet and facing generally outward from said cabinet in the direction of said front face.

19. The sound reproduction system of claim 15 wherein said signal supplying means includes a crossover network including a choke connected to said low frequency range speaker means and a plurality of condensers connected to said high frequency range speaker means.

20. The sound reproduction system of claim 17 wherein said signal supplying means includes a crossover network including a choke connected to said low frequency range speaker means, a choke and a condenser connected to said mid-frequency range speaker means and a plurality of condensers connected to said high frequency range speaker means.

21. The sound reproduction system of claim 15 further comprising variable resistance means interposed between one of said pair of low frequency range speaker means and said means for supplying electrical signals, for control of signal intensity supplied to said one relative to said other of said pair of low frequency range speaker means.

22. The sound reproduction system of claim 20 further comprising mid-frequency range speakers physically coordinated to said system.

* * * * *